US005722476A

United States Patent [19]

Lujan-Sanchez et al.

[11] Patent Number: 5,722,476

[45] Date of Patent: Mar. 3, 1998

[54] REVERSIBLE SLATTED SHUTTER

[75] Inventors: Francisco Lujan-Sanchez, Illescas; Emiliano Martin-Gomez, Yuncos, both of Spain

[73] Assignee: Ceraper S.L., Toledo, Spain

[21] Appl. No.: 750,554

[22] PCT Filed: Apr. 3, 1996

[86] PCT No.: PCT/ES96/00075

§ 371 Date: Dec. 12, 1996

§ 102(e) Date: Dec. 12, 1996

[87] PCT Pub. No.: WO96/32562

PCT Pub. Date: Oct. 17, 1996

[30] Foreign Application Priority Data

Apr. 12, 1995 [ES] Spain ..... 9501021 U
Feb. 22, 1996 [ES] Spain ..... 9600428 U

[51] Int. Cl.[6] ..... E06B 9/08

[52] U.S. Cl. ..... 160/133; 160/32

[58] Field of Search ..... 160/133, 32, 35, 160/36, 26, 188, 310

[56] References Cited

U.S. PATENT DOCUMENTS

| | | | |
|---|---|---|---|
| 705,553 | 7/1902 | Blake | 160/133 |
| 1,665,028 | 4/1928 | Halvorsen | 160/133 |
| 3,516,469 | 6/1970 | McDonald | 160/36 X |
| 4,683,932 | 8/1987 | Bubendorff | 160/133 |
| 4,889,381 | 12/1989 | Tamblyn et al. | 160/133 X |
| 5,484,007 | 1/1996 | Rejc | 160/133 |
| 5,586,592 | 12/1996 | McGregor | 160/133 |

*Primary Examiner*—David M. Porol
*Attorney, Agent, or Firm*—Wolf, Greenfield & Sacks, P.C.

[57] ABSTRACT

A reversible shutter includes slats mounted between lateral guides and includes at the ends of the slats sliding elements which run through the lateral guides and through connected labyrinthian guides located within a shutter box. Each labyrinthian guide includes an inlet and an outlet which are connected to the respective lateral guide. During rolling and unrolling of the slatted shutter, the front face and the back face of the slats are exposed, making it possible to clean both faces of the slatted shutter from one side.

9 Claims, 4 Drawing Sheets

REVERSIBLE SLATTED SHUTTER

FIELD OF THE INVENTION

The invention is related to a reversible slatted shutter which is structured in specific parts to allow cleaning from the same side, as for instance from inside the house in which the shutter is installed. The main parts providing this new concept consist of lateral rails or guides fitted in the shutter box and along which the slatted shutter runs in a labyrinthian manner designed to present both faces toward the same side according to the rolling/unrolling direction.

BACKGROUND OF THE INVENTION

At present, the cleaning of building shutters can only be accomplished from the inside, unless the worker or cleaning person is lowered externally down the facade, which is obviously dangerous and requires means not normally available to the users or citizens. Another way of cleaning the external face of the shutter is to dismount the shutter box lid to enable cleaning through the opening. With this system or procedure, regardless of the complexity involved in mounting and dismounting the shutter box lid, cleaning is not done effectively.

As a result of this, the external face of the shutters usually reveal dirt which is difficult to clean.

SUMMARY OF THE INVENTION

The slatted shutter of the invention solves this problem on the basis of a shutter assembly and guide mechanism which allows both sides of the shutter to be exposed toward the interior of the house, thereby allowing the shutter to be easily and comfortably cleaned.

More specifically, the slatted shutter of the invention is formed by a series of hollow slats on the ends of which are installed respective caps which carry respective pairs of wheels which slide along corresponding lateral guides provided on the sides of the window hollow, which guides extend upward in a kind of spiral which, on being traversed by the slatted shutter, makes the face of the shutter facing the outside at the inlet of the spiral to face the inside at the outlet, and vice versa.

The pairs of caps with their sliding wheels fitted at the end of each slat provide a means of traction for the slats and consequently the slatted shutter, said traction being achieved as a result of the fact that the teeth of a pinion which rotates integrally with the slatted shutter's general axis come between the wheel axes, said pinion engaging another pinion driven from a rolling traction belt pulley, which belt is fitted with a conventional tension device at its lower end.

Said slatted shutter includes alternatives for several of its elements, involving a series of improvements over the basic slatted shutter providing increased functional efficiency and proper guiding of the shutter.

One of the improvements affects the slats themselves, so that according to the invention the intermediate slats, namely all the slats in the slatted shutter save for the end (upper and lower) slats, present three cavities or compartments, one of said end cavities being open longitudinally for engagement between adjacent slats in view that each slat's opposite longitudinal edge presents a hook-shaped extension which is lodged in and hooked onto the open cavity at the opposite edge, said engagement being effective in that it prevents the slats from becoming disengaged and nonetheless allows each slat to tilt in respect to the adjacent slats to allow for the direction changes imposed along their movement over the labyrinthian guides.

Into both the remaining end tubular compartments or cavities in each slat, respective protrusions pertaining to a flat part adhered to the end of each slat are coupled by insertion, said part being provided with cylindrical, mutually equidistant sprockets which provide the sliding means for the slats and consequently for the slatted shutter, which sprockets also provide the means of meshing with the teeth of the corresponding pinions for the traction and guiding of the slats.

The end slatted shutter slats (upper and lower) finish in a closed curved shape, establishing a rounded edge which facilitates the sliding of the slatted shutter in both directions.

Another improvement introduced in the slatted shutter of the invention is that the sides having the channels which establish the labyrinthian guides incorporate at least a couple of appropriately spaced toothed wheels for engaging the cylindrical sprockets corresponding to the parts coupled onto the ends of the slats, so that incorporating one or more toothed wheels (depending on the length of the labyrinthian channel) facilitates traction, movement and adequate guidance of the slats along the guides.

Said toothed wheels are mounted on respective axes arranged on the side of the labyrinthian channel, being intercalated in it, so that on the end opposite the external face of the sides the axes incorporate respective pinions which simultaneously mesh with a toothed wheel or crown whose axis is the driving or propelling axis, i.e. the crown is driven by the driving axis either manually or by a motor.

One of the axes mounting the two engaging slat traction toothed wheels extends from one side to the other, thereby associating both mechanisms, on both sides.

BRIEF DESCRIPTION OF THE DRAWINGS

These and other characteristics, in addition to the operation of the slatted shutter, shall be more easily understood on the basis of the following description with the help of a set of drawings attached hereto wherein the following is represented merely within an orientating, non-limiting character.

DETAILED DESCRIPTION

The slatted shutter thus formed is an alternative to the embodiment shown in FIGS. 3 through 11, incorporating a series of improvements affecting the slats (1), the labyrinthian guiding channels and the shutter traction means.

Thus, the improved slatted shutter presents end slats (1') and (1"), corresponding to the upper and lower slats, which present some specific features.

Figure 8:
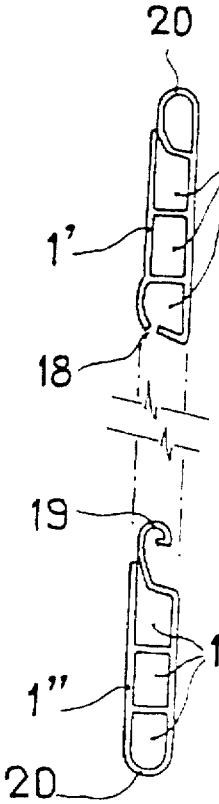
FIG. 8 is an end view of both upper and lower slats finished to a rounded shape, also corresponding to the slatted shutter shown in FIGS. 3 to 7.
Figure 9:
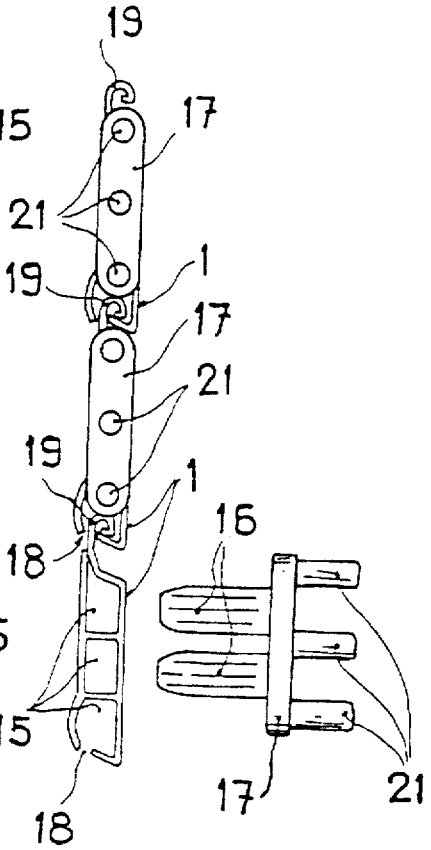
FIG. 9 is an end detail showing several slats coupled to one another, two of which slats incorporate the parts fitted with traction sprockets. In said figure, one of the parts is viewed laterally, also corresponding to the slatted shutter shown in FIGS. 3 to 8.
Figure 10:
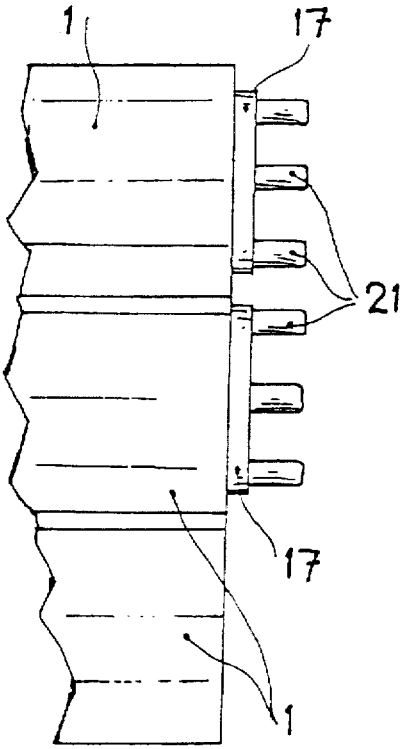
FIG. 10 is a lateral view of the end portions corresponding to the slats shown in the previous figure.

In turn, each slat (1) is fitted with intermediate lengthwise partitions providing three or more cavities or compartments—corresponding to reference (15)—for receiving the insertion coupling of the portions (16) pertaining to one of the parts (17), one of the end compartments being open longitudinally to establish an opening (18) located between a slightly curved length or other angle, as can be seen in FIGS. 8 and 9. The opposite end of the opening (18) presents an extension ending in a hook (19) shape, so that the consecutive engagement between slats (1) is achieved by the engagement of hook (19) in opening (18), thus preventing disengagement of the slats although allowing them to tilt in relation to one another to allow for changes in their trajectory or direction of movement.

The end slats (1') and (1") are fitted respectively with a hook (19) and an opening (18). Specifically, the upper slat (1') has an opening (18) in its lower edge, while the lower slat (1") has a hook (19) in its upper edge. Furthermore, the free longitudinal edge in both end slats (1') and (1") is provided with a rounded shape (20) to facilitate sliding.

Figure 11:
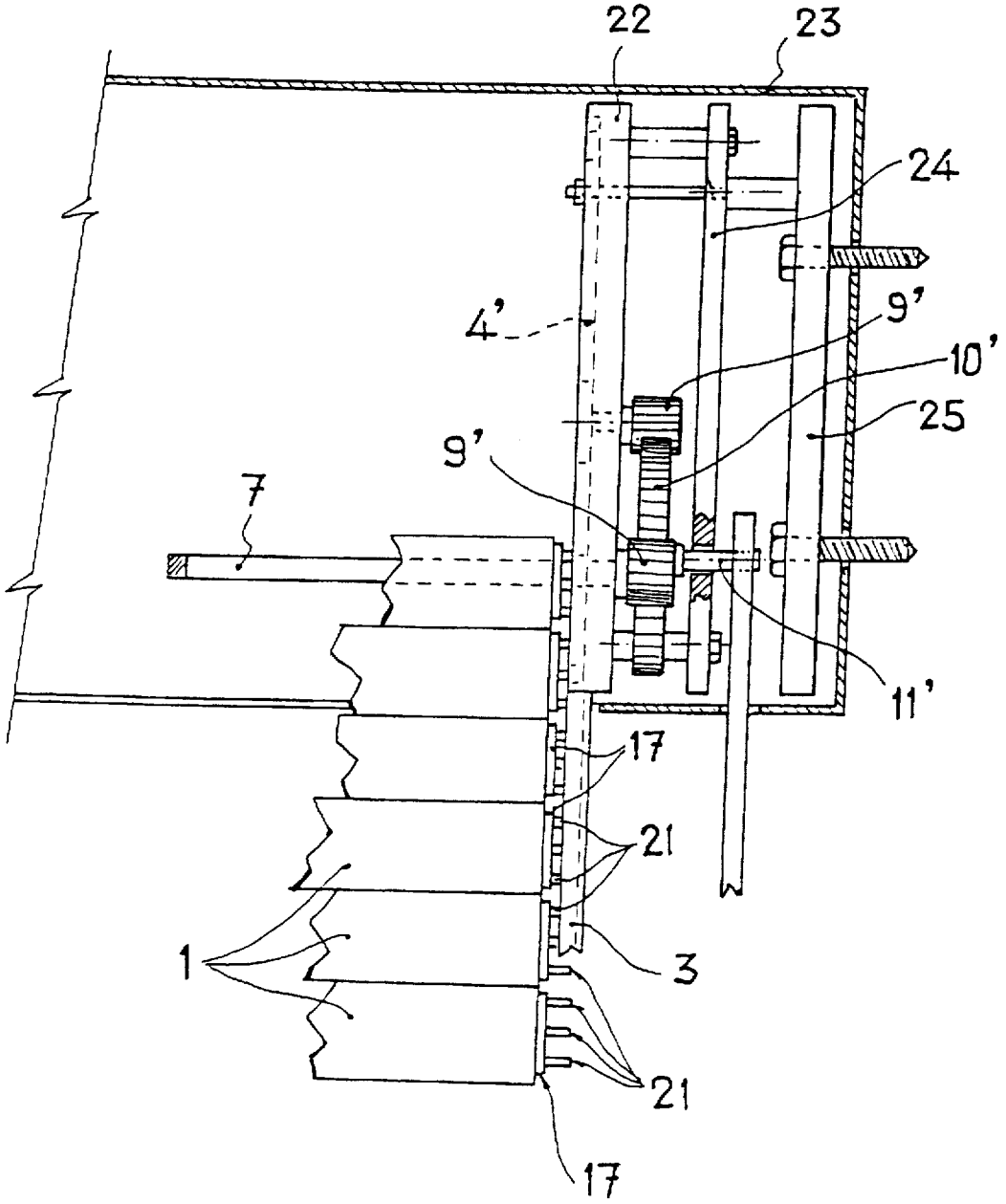
FIG. 11 is a sectional front view of an end portion of the slatted shutter assembly shown in FIGS. 3 to 10, revealing the main elements and parts.

The parts (17), and the portions (16) emerging perpendicularly from one of their sides for coupling by insertion into the ends of the cavities or compartments (15) in the slats (1) or (1') or (1"), present on their opposite side three cylindrical sprockets (21) which constitute a sliding and traction means along the trajectory of the slatted shutter or slats forming the shutter along the lateral guides (3) and the labyrinthian guides (4') provided on the sides (22) which are mounted and attached to the end or lateral parts of the corresponding shutter box (23). These sides (22) are formed by respective plates fixed to the supports (24) which in turn are fixed to the supports (25) attached to the sides of the shutter box (23), as shown in FIG. 11.

Figure 1:
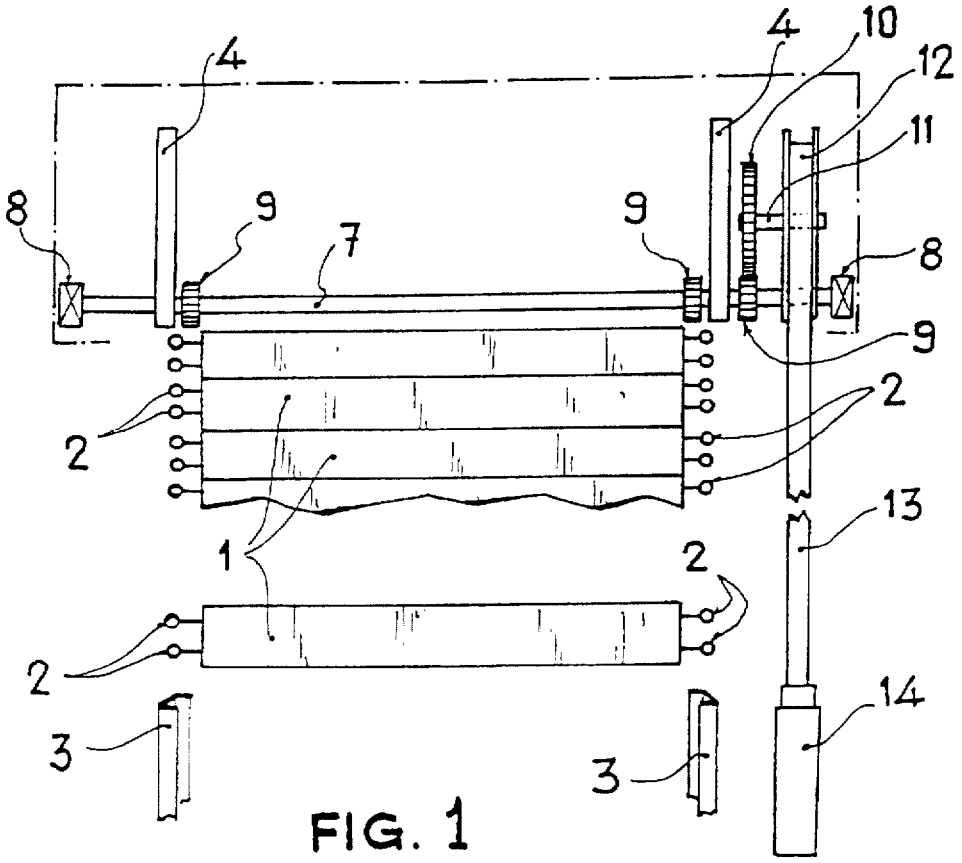
FIG. 1 is a schematic front view of part of the reversible slatted shutter of the invention.
Figure 2:
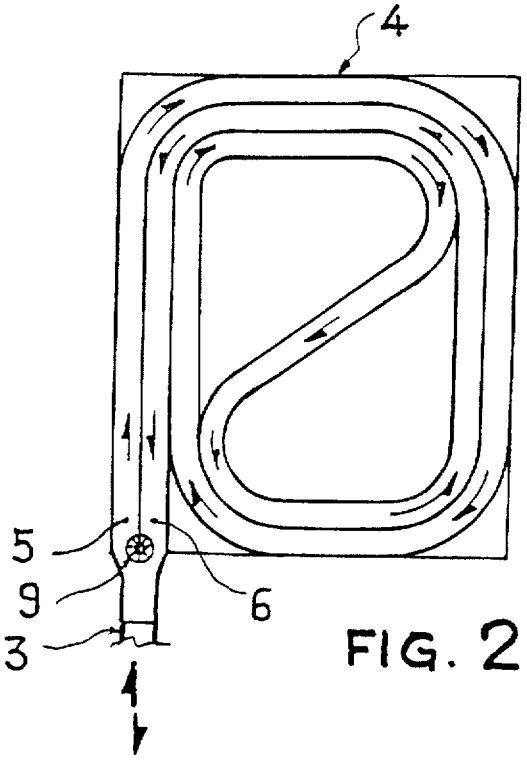
FIG. 2 shows one of the spirals or labyrinthian guide for the slatted shutter shown in the previous figure.
Figure 3:
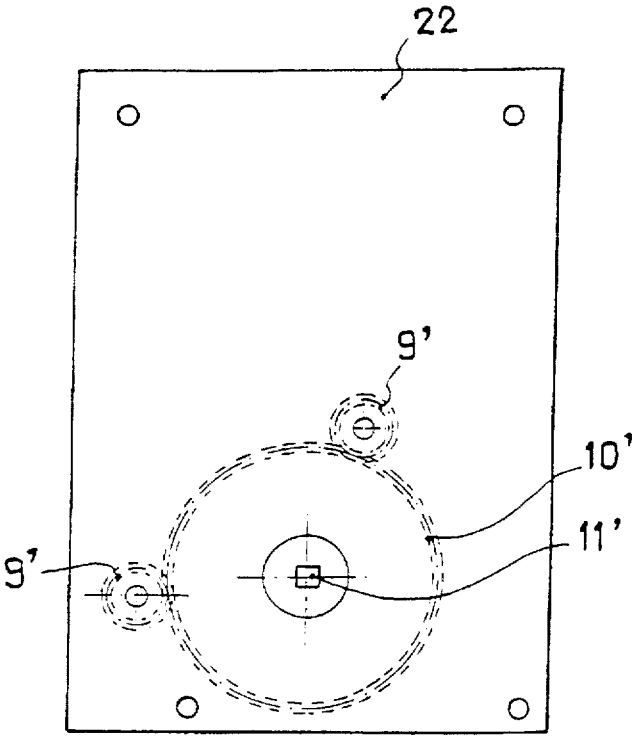
FIG. 3 is a view of the external face of the two sides provided on the ends or sides of the shutter box, incorporating the improvements. This figure shows the two pinions simultaneously meshing with the crown mounted on the drive shaft.
Figure 4:
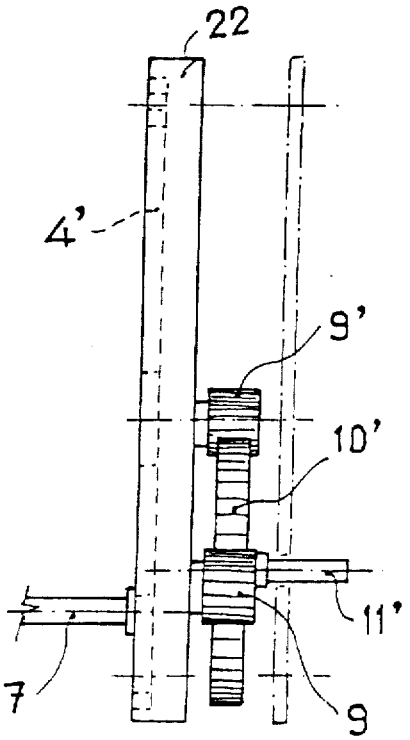
FIG. 4 is a lateral view of the side shown in the previous figure, revealing the meshed pinions and crown.
Figure 5:
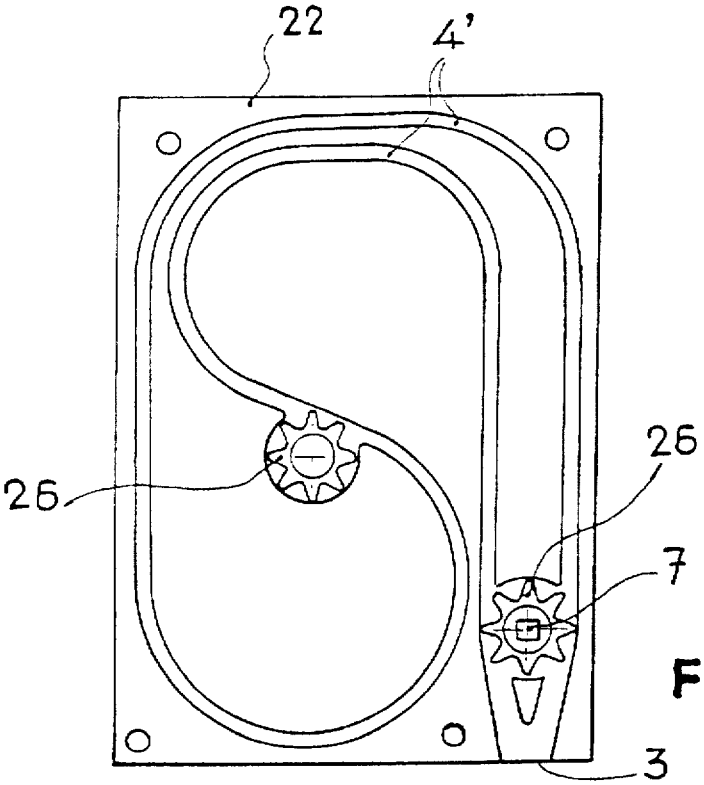
FIG. 5 is a view of the internal face on the same side as in FIGS. 3 and 4, showing the toothed traction wheels and the labyrinthian guiding channel in which said wheels are intercalated.
Figure 6:
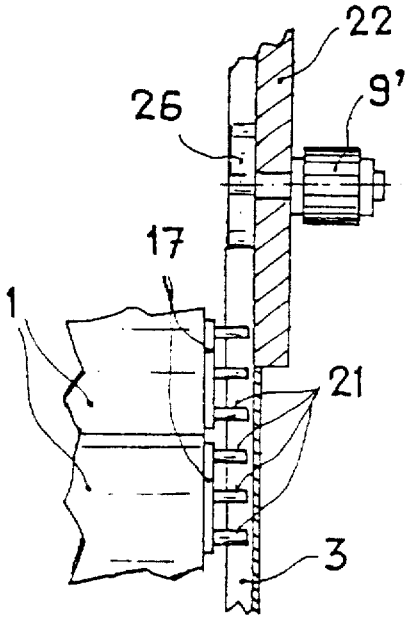
FIG. 6 is a lateral section detail of the sliding guide for the cylindrical sprockets of the parts mounted on the ends of the slats corresponding to the slatted shutter shown in FIGS. 3 to 5.
Figure 7:
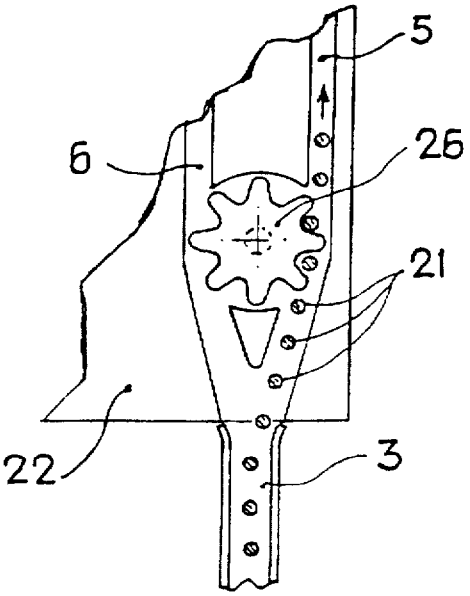
FIG. 7 is a detail showing the lateral guide inlet wherein the labyrinthian guide inlet and outlet converge, intercalating one of the traction wheels corresponding to the slatted shutter shown in FIGS. 3 to 6.

Onto the external face of side (22) is mounted a toothed crown (10') whose axis is the drive axis (11') for driving the slatted shutter either manually or by a motor. On this same external face of sides (22) are mounted two or more pinions (9') meshing simultaneously with crown (10'), so that rotation of the crown produces rotation of said pinions (9') and consequently of the respective toothed wheels (26) mounted onto the other face of the sides (22) and on the same axes as pinions (9'). One of these wheels (26), specifically the one located in the intersection between the lateral guides (3), the inlets (5) and the outlet (6) of the channel or labyrinthian guide (4'), is associated to that of the opposite side (22) through the common axis (7). The other toothed wheel (26), or wheels, if further wheels are provided, is located in between and along the trajectory forming the channel or labyrinthian guide (4'), in a manner that one or the other pinion(s) (26) provide—by the rotation of the crown (10') and consequently of the pinions (9')—traction to the slats (1), since the distance between the sprockets (21) is calculated to achieve a perfect meshing between the sprockets and the toothed wheels (26), as shown in FIG. 7.

Thus, each time that the crown (10') is driven in one direction or the other, traction and movement of the slatted shutter is effected along the lateral (3) and labyrinthian (4') guides, causing the slatted shutter, at the inlet (5) of the labyrinthian guides (4'), to present a face to the exterior, while at the outlet (6) it presents the opposite face as a result of the labyrinthian or winding trajectory of the channel or guide (4') provided in each side.

We claim:

1. A reversible shutter comprising:

a plurality of slats mounted between lateral guides and rolled and unrolled by a manual or motor-driven belt, said slats comprising elongated hollow bodies having sliding means coupled to ends thereof;

a shutter box having opposite sides and including labyrinthian guides mounted on said opposite sides, each of said labyrinthian guides having an inlet and an outlet coupled to one of the lateral guides, said labyrinthian guides each providing a direction change such that a front face of said slats is exposed at the inlet and a back face of said slats is exposed at the outlet; and a driving mechanism for moving slats along said lateral guides and said labyrinthian guides so as to expose the front face or the back face of said slats.

2. A reversible shutter as defined in claim 1, wherein said driving mechanism comprises a main shaft mounted on lateral supports, a rotation means mounted on said main shaft and driven from a pulley forming an upper driving belt tension device and traction means for the sliding means coupled to the ends of the slats so that rotation of the rotation means produces traction and movement of the slats along the lateral guides and the labyrinthian guides.

3. A reversible shutter, according to claim 2, characterized in that the slat traction toothed wheels are mounted on the same axis as the respective pinions located on the other side or end portion of the respective sided plate, said pinions meshing simultaneously with the crown which acts as the driving element as a result of it being associated to the corresponding manual or motor drive means, with the feature that the axis corresponding to the toothed wheel located in the intersection between the lateral guide and the labyrinthian guide's inlet and outlet is attached to the axis on the opposite side, thereby establishing the main axis mutually interrelating or associating the twin mechanisms located on either side.

4. A reversible shutter, according to claim 3, characterized in that one of the longitudinal slat edges has a longitudinal opening with an angled portion into which opening the opposite longitudinal edge finishing in a hook shape pertaining to the adjacent slat is inserted and coupled; with the feature that the free longitudinal edge in the upper and lower end slats presents a round shape designed to facilitate its sliding; the ends of the longitudinal slat cavities or compartments having mounted by insertion therein emerging portions of a flat part which is adhered to the respective slat end, said part presenting on its external face equidistant cylindrical sprockets which establish the meshing means for the toothed wheels provided in the labyrinthian guide for the slat traction and corresponding movement of the slatted shutter.

5. A reversible shutter, according to claim 2, characterized in that one of the longitudinal slat edges has a longitudinal opening with an angled portion into which opening the opposite longitudinal edge finishing in a hook shape pertaining to the adjacent slat is inserted and coupled; with the feature that the free longitudinal edge in the upper and lower end slats presents a round shape designed to facilitate its sliding; the ends of the longitudinal slat cavities or compartments having mounted by insertion therein emerging portions of a flat part which is adhered to the respective slat end, said part presenting on its external face equidistant cylindrical sprockets which establish the meshing means for the toothed wheels provided in the labyrinthian guide for the slat traction and corresponding movement of the slatted shutter.

6. A reversible shutter as defined in claim 2, wherein said traction means comprises toothed wheels having teeth and wherein said sliding means comprises a plurality of pins located between the teeth of respective toothed wheels, wherein said pins are driven along the respective guides by said traction means.

7. A reversible shutter as defined in claim 1, wherein said labyrinthian guides comprise plates provided on opposite sides of said shutter box, each of said labyrinthian guides including two or more toothed wheels providing traction to the slats, one of said toothed wheels being located at an intersection area between the respective lateral guide and the inlet and outlet of said labyrinthian guide, and another toothed wheel being located to facilitate traction and guidance of said slats through said labyrinthian guides.

8. A reversible shutter, according to claim 7, characterized in that the slat traction toothed wheels are mounted on the same axis as the respective pinions located on the other side or end portion of the respective sided plate, said pinions meshing simultaneously with the crown which acts as the driving element as a result of it being associated to the corresponding manual or motor drive means, with the feature that the axis corresponding to the toothed wheel located in the intersection between the lateral guide and the labyrinthian guide's inlet and outlet is attached to the axis on the opposite side, thereby establishing the main axis mutually interrelating or associating the twin mechanisms located on either side.

9. A reversible shutter, according to claim 7, characterized in that one of the longitudinal slat edges has a longitudinal opening with an angled portion into which opening the opposite longitudinal edge finishing in a hook shape pertaining to the adjacent slat is inserted and coupled; with the feature that the free longitudinal edge in the upper and lower end slats presents a round shape designed to facilitate its sliding; the ends of the longitudinal slat cavities or compartments having mounted by insertion therein emerging portions of a flat part which is adhered to the respective slat end, said part presenting on its external face equidistant cylindrical sprockets which establish the meshing means for the toothed wheels provided in the labyrinthian guide for the slat traction and corresponding movement of the slatted shutter.

* * * * *